United States Patent [19]

Biswas

[11] Patent Number: 4,735,351

[45] Date of Patent: Apr. 5, 1988

[54] DISPENSER FOR TAPE ROLLS

[75] Inventor: Ranjit Biswas, Plainsboro, N.J.

[73] Assignee: Thomas & Betts Corporation, Bridgewater, N.J.

[21] Appl. No.: 450,307

[22] Filed: Dec. 16, 1982

[51] Int. Cl.[4] ..... B65H 35/10

[52] U.S. Cl. ..... 225/25; 225/52; 225/82

[58] Field of Search ..... 225/25, 37, 34, 38, 225/52, 80, 85, 51, 26, 82, 84, 86

[56] References Cited

U.S. PATENT DOCUMENTS

| | | | |
|---|---|---|---|
| 593,035 | 11/1897 | Springsteen . | |
| 757,844 | 4/1904 | Scott . | |
| 2,250,774 | 7/1941 | Piller | 242/55.5 |
| 2,447,145 | 8/1948 | Van Cleef et al. | 164/84.5 |
| 2,470,250 | 5/1949 | Kienle | 242/55.4 |
| 2,484,673 | 10/1949 | Becker | 242/55.5 |
| 2,610,000 | 9/1952 | Vierson | 242/55.4 |
| 2,678,777 | 5/1954 | Donkin | 242/55.5 |
| 2,709,049 | 5/1955 | Weis | 242/55.5 |
| 2,710,152 | 6/1955 | Jones | 242/55.5 |
| 2,748,931 | 6/1956 | Taylor | 206/52 |
| 2,750,029 | 6/1956 | Morgan | 206/52 |
| 2,839,139 | 6/1958 | Vogt | 225/25 |
| 3,034,691 | 5/1962 | Gershen | 225/25 |
| 3,072,280 | 1/1963 | Spadaro | 220/4 |
| 3,217,955 | 11/1965 | Tinkey | 225/47 |
| 3,281,033 | 10/1966 | Stutzman et al. | 225/38 |
| 3,452,879 | 7/1969 | Guarino | 211/71 |
| 3,502,252 | 3/1970 | Mariani | 225/33 |
| 3,547,327 | 12/1970 | Mariana | 225/38 |
| 3,948,455 | 4/1976 | Schwartz | 242/55.3 |
| 4,252,258 | 2/1981 | Plummer, III | 225/25 |
| 4,262,835 | 4/1981 | Wrobel | 225/25 |

FOREIGN PATENT DOCUMENTS

| | | |
|---|---|---|
| 2204799 | 8/1973 | Fed. Rep. of Germany . |

*Primary Examiner*—E. R. Kazenske
*Assistant Examiner*—James L. Wolfe
*Attorney, Agent, or Firm*—Robert M. Rodrick; Salvatore J. Abbruzzese

[57] ABSTRACT

A wire marker dispenser including a plurality of chambers to receive tape rolls therein. A retaining member adjacent each chamber engages a portion of the tape extending from the roll and prevents the tape extent from rolling back onto the tape roll. The tape dispenser also includes an interconnection means for connecting plural dispensers together.

17 Claims, 3 Drawing Sheets

DISPENSER FOR TAPE ROLLS

FIELD OF THE INVENTION

This invention relates generally to a dispenser for an adhesive tape product wound in a roll and more particularly to a dispenser for multiple rolls of tape for marking wires.

BACKGROUND OF THE INVENTION

In a wide variety of electrical applications, large numbers of wires or cables are often used to interconnect various components. When working in such an environment where it is necessary to connect and disconnect more than one wire at a time, confusion as to the proper arrangement of the wires may result, as they are often similar in appearance. It has been long known to mark the wires to be disconnected so that the wires will be identified for subsequent reconnection. A common device for marking the wire is to employ marking tapes having a first face upon which one or more series of indicia may be placed and a second face having a coating of a pressure-sensitive adhesive. Such marker tapes may be dispensed in selectable lengths in accordance with the size of the cables or wires to be marked. Due to the large number of cables or wires usually found in a system, a dispenser capable of dispensing a large variety of indicia-bearing tape is required.

One such device is shown and described in U.S. Pat. No. 3,502,252 and assigned to the assignee of the present invention. This marking tape dispenser includes a housing constructed of individual dispensing modules, each of which contains a single roll of marking tape. Each of the marking tapes would preferably bare different indicia. This tape dispenser also includes a cutting blade for cutting off selected lengths of tape from the roll and an adjacent platform for retaining the tape end for subsequent use.

It has been found that with multiple roll tape dispensers, as well as in single roll dispensers, the tape end has a tendency to dislodge from the retaining platform and turn back onto the tape roll. This may be due to the curvature of the tape roll itself or the tape roll may be inadvertently rotated in the wrong direction, bringing the tape end back into the roll. Such inadvertent movement may be especially evident in the crowded environment in which an electrician must usually work. It is both time-consuming and inefficient for the electrician to stop work and search for the end of the tape roll between uses should the tape curl back onto itself.

One attempt at eliminating the roll back problem is found in a wire marker dispenser sold by 3M under the trademark "SCOTCH CODE". This device provides a housing cover which, upon closing, engages the adhesive surface of the tape, securing the tape between the cover end and the housing. Upon opening the cover, the tape end is released and a free end is provided. While this dispenser securely retains the tape end when the cover is in the closed position, it fails to prevent roll-back when the cover is open. Further, this dispenser cannot operate with the cover closed as no portion of tape is accessible outside the closed cover.

The dispenser art has further seen partially or totally enclosed tape dispensers which provide an extending edge of tape exteriorly of the dispenser through an opening, such as shown in U.S. Pat. Nos. 757,844, 2,447,145 and 4,252,258. However, these dispensers do not easily provide accessible exit for the tape in the dispenser as normally the tape must be "fed" or "threaded" through the narrow opening. As with the previously mentioned dispensers, this procedure is also time-consuming and inefficient.

SUMMARY OF THE INVENTION

It is therefore an object of the present invention to provide an improved dispenser for adhesive tape products.

It is a further object to provide a wire marker dispenser which provides a readily accessable roll end.

In the efficient attainment of these and other objects, the present invention looks toward providing a dispenser having a housing which supports therein at least one roll of adhesive tape. The housing has a front wall surface having an opening therethrough for providing an exit for the tape length. The tape is accessible to the opening by a slot extending down into the opening, allowing the tape to be inserted therein. Once inserted, the tape will be retained in the opening.

DETAILED DESCRIPTION OF THE PREFERRED EMBODIMENT

Figure 1:
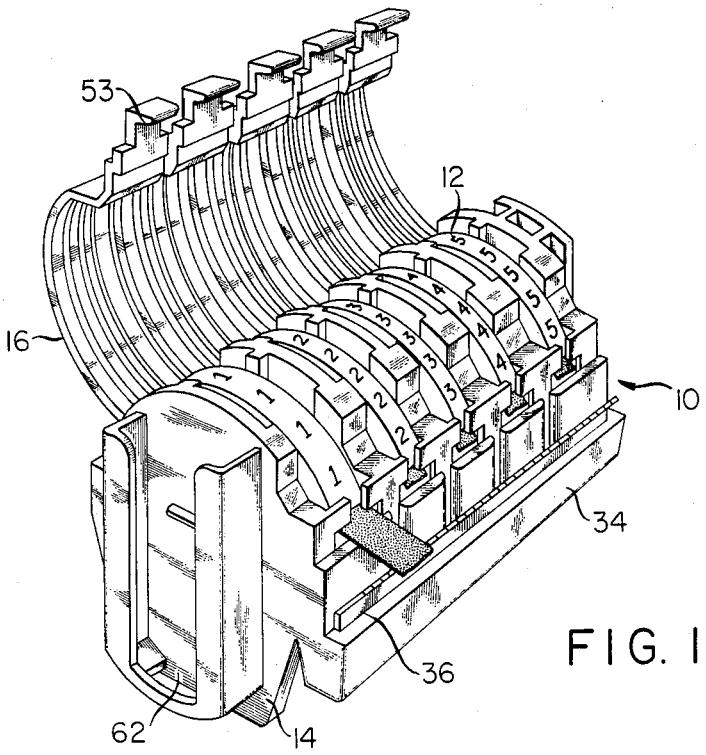
FIG. 1 is a perspective view of the tape dispenser of the present invention with the covers shown in an opened position exposing the tape rolls disposed therein.

In FIG. 1 wire marker dispenser 10 is shown supporting therein a plurality of tape rolls 12, each tape roll comprising a quantity of adhesive tape wound about a core. Although the present embodiment shows a tape dispenser having five (5) tape rolls therein, it is within the contemplation of the present invention to construct a dispenser for accommodating any number of tape rolls. In preferred form, tape rolls 12 are employed for marking cable or wire, each having one side bearing different identifying indicia, for example, sequential letters or numerals or color coding and a second side having an adhesive coating for securing the tape to the wire or cable to be marked. While marking tape is shown by way of example, it is within the contemplation of the present invention to employ dispenser 10 for use with a variety of adhesive tape products wound on rolls, both decorative and utilitarian.

Figure 2:
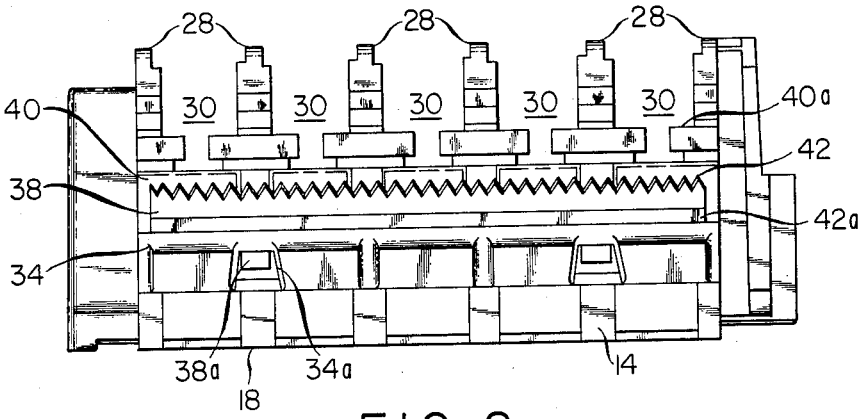
FIGS. 2 and 3 are front and top elevational showings respectively, of the tape dispenser of FIG. 1 with the tape rolls and blade removed for clarity and the covers shown in a fully opened position.
Figure 3:
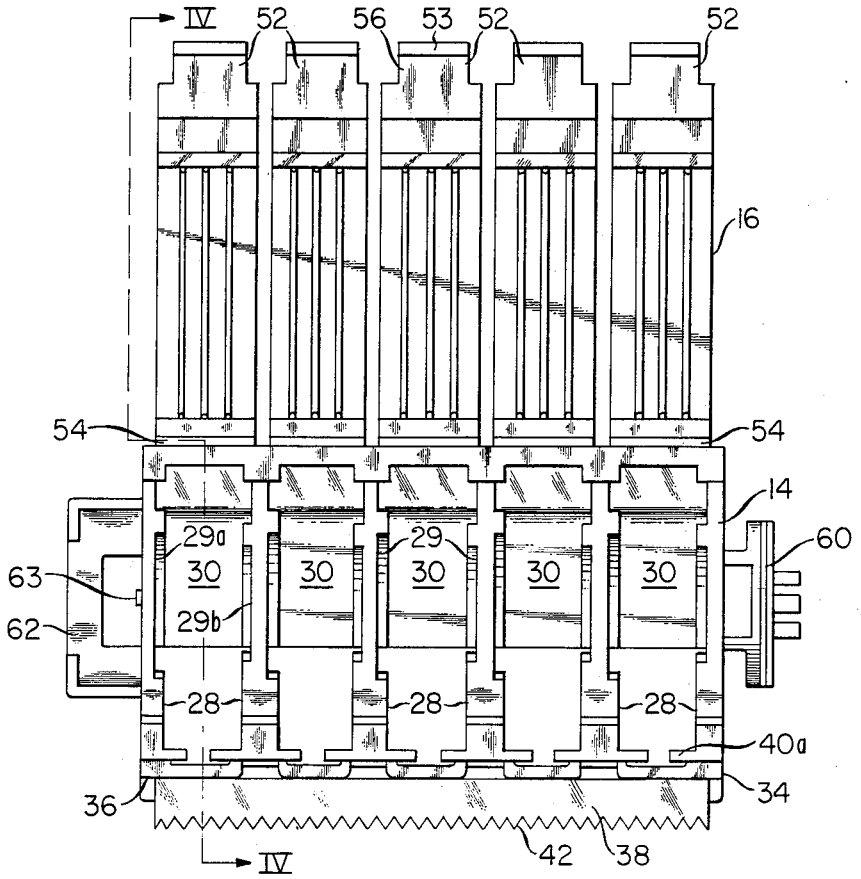
Figure 4:
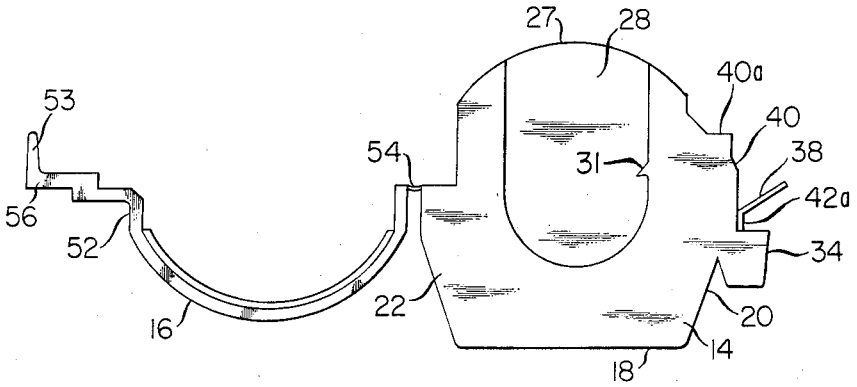
FIG. 4 is a sectional showing of the tape dispenser of the present invention taken along the lines IV—IV of FIG. 3.

Referring now to FIGS. 2–4, dispenser 10 is an elongate, generally hollow member typically integrally formed of a suitable plastic material such as polypropylene. Dispenser 10 comprises two main shell-type members, a lower base shell 14 and a multi-sectioned upper shell 16, which is hingedly attached to and engages with the lower shell to form a fully enclosed container and defining a plurality of individually openable covers as described hereinbelow. Base shell 14 includes a substantially flat bottom portion 18 and upwardly extending side walls 20 and 22 angularly disposed to bottom portion 18. A series of transverse partitions 28 extend in spaced disposition along the longitudinal extent of the base shell 14, the opposite end partitions forming the end walls of base shell 14. Each of partitions 28 spans the width of base shell 14 and extends upwardly beyond the upper extent of side walls 20 and 22. Partitions 28 also include rounded upper extents 27 (FIG. 4) so that the lower shell portion 14 can accommodate the multi-sectioned upper shell portion 16, as will be described hereinafter.

Figure 5:
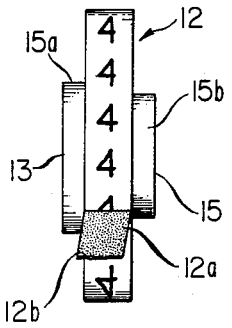
FIG. 5 is a perspective showing of the tape roll of FIG. 1 wound on a tape core.

In the present embodiment, base shell 14 is sectioned by the partitions 28 to form five tape roll receiving chambers generally denoted as 30, each of which receives a different indicia bearing tape roll 12 therein. In order to accommodate the tape rolls, a conventional track-type arrangement may be employed in chambers 30 wherein each partition 28 includes a pair of slotted portions 29 (FIG. 3) formed on opposite sides thereof for receipt of one end of a tape roll core 13 (FIG. 5). In each chamber 30, the internal walls of partitions 28 include one pair of oppositely facing sloted portions 29 which are U-shaped, having an open upper end adjacent the upper extent 27 of the partitions. As above described and shown in FIG. 5, tape roll 12 is wound on a tape core 13 which has an axial portion extending through the center of the tape roll 12. The projecting outer extents of the tape core 13 form hub ends 15 which are received into the slots 29. Each hub end 15 of the tape core 13 has a diameter which is closely dimensioned to the slotted portions 29 of the partitions 28. In this manner a tape roll 12 may be dropped in the slotted portions 29, with the hub ends 15 of the tape core 13 being received in the track formed by the opposed slotted portions 29. Each slotted portion 29 also includes a small projection 31 located therein. Projection 31 extends from one side wall of the U-shaped slotted portion 29 into the central track portion and acts as a detent to prevent inadvertent withdrawal of the tape roll. The detent 31 secures tape roll 12 in the slotted portion 29, however, allows for free rotation of the tape roll therein.

As shown in FIG. 3, in the left-hand tape receiving chamber 30, in a preferred form each pair of the oppositely facing slotted portions **29*a* and 29*b* are of different width to uniquely accommodate different diametered tape hub ends 15*a* and 15*b*. Each axially opposite hub end 15*a* and 15*b* corresponds to the different widths of facing slotted portions 29*a* and 29*b*. As such, tape roll 12 could only be inserted in one direction with the smaller diameter hub end 15*b* of the tape core inserted into the smaller slotted portion 29*b* and the larger hub end 15*a* of the tape core inserted into the larger slotted portion 29*a***.

Referring again to FIGS. 2, 3 and 4, base shell 16 includes adjacently above side wall 20, an elongate support structure 34 which extends the length of the base 16 and protrudes outwardly therefrom as shown in FIG. 4. Support structure 34 includes a groove 36 (FIG. 3) in an upper surface which extends the length of the structure 34. Groove 36 accommodates therein an elongate saw-type cutting blade 38 (FIGS. 1 and 4), preferably made of metal. Blade 38 is suitably secured to support structure 34 by tab portions **38*a* extending from the blade to engage receiving openings 34*a* of support structure 34. Any suitable mounting means may be employed to secure blade 38 to support structure 34. Blade 38 includes a saw-type cutting edge 42 which extends angularly outwardly from the flat metal plate body portion 42*a* secured in slot 36. In this position, cutting edge 42 will be disposed directly beneath portions of tape extending from tape rolls 12** for cutting a length of tape therefrom as will be described hereinafter.

Above blade support structure 34, base shell 14 includes a front retaining wall 40, terminating in a top portion **40*a* which accommodates the closed lid portion 16**, as will be described hereinafter.

Figure 6:
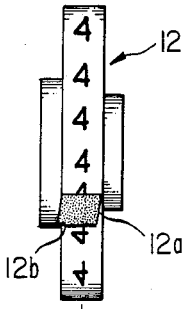
FIG. 6 is a partial, fragmented showing of the dispenser of FIG. 1 with one roll shown in exploded view.
Figure 6:
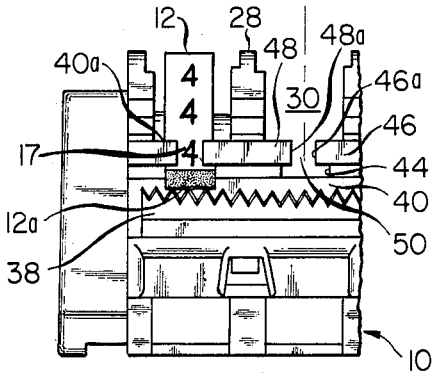

Referring now to FIG. 6, there is shown in fragment, a pair of tape receiving chambers 30. For simplification of description, as each of the retaining members are identical, reference will be made to one such member.

Tape receiving chamber 30 is bounded laterally by partitions 28 and in the front by front retaining wall 40. Tape roll 12 is supported for free rotation in the slotted portion of partitions 28 as above described. Front retaining wall 40 includes therein an elongate opening 44 which is generally rectangular having a lengthwise extent greater than its height. Opening 44 permits tape end length **12*a* from roll 12 to extend therethrough and thereby receives therein a transverse tape extent 17, spaced from the tape end. Opening 44 has a longitudinal expanse which is slightly less than the transverse tape extent 17 which is accomodated therein. The portion of front retaining wall which bounds openings 44 will thus engage the tape extent 17 in an interference fit. The tape 12 becomes bowed or otherwise deformed along its transverse extent 17 as it extends through opening 44. Projecting inwardly from partitions 28 over opening 44 is a pair of oppositely facing gate members 46 and 48 formed adjacent upper surface 40*a* of wall 40. Gate members 46 and 48 have facing surfaces 46*a* and 48*a* which form between them a longitudinal slot 50 centrally located and in communication with opening 44. Slot 50 permits tape extent 17 to be readily inserted in opening 44. Without slot 50, tape end length 12*a* would have to be "fed" through opening 44 from inside chamber 30. Instead, the tape extent 17 will easily deform along its transverse expanse and thereby pass between gate members 46 and 48. As the tape is easily deformable along its transverse expanse it will permit swift and easy insertion of the tape into opening 44. Further, slot 50 is constructed to be sufficiently wide to allow the tape extent 17** to be easily located therein, thus facilitating insertion.

Once tape extent 17 is insertably passed through slot 50 and past gate members 46 and 48, it will be accommodated in opening 44. The lower expanse of slot 50, formed by the bottom portions of gate members 46 and 48, prevents the tape extent 17 from moving back up into slot 50 and out of opening 44. In this manner gate members 46 and 48 prevent tape end length **12*a* from rolling back onto roll 12. In addition, as the upper surface of tape roll 12 is covered with an adhesive coating, the tape extent 17 will adhere to the bottom surface and/or the front portion of gate member 46 and 48 as it extends therethrough. As the extent of the gate members 46 and 48 engaging the tape extent 17, is minimal, for example, on the order of twenty (20) mils, there is only slight adherence of the tape to the gate members which will not result in significant degradation of the adhesive qualities of the tape. However, this slight adhesive engagement will be sufficient to prevent the tape extent from being pulled back through opening 44**.

Further, the frictional engagement caused by the interference fit of the wider tape extent 17 and the narrower opening expanse 44 will also prevent the tape end from being pulled back through opening 44.

It can be seen that the adhesive and frictional engagement will prevent the tape end length 12*a* from rolling back onto the tape roll 12. As above described, such rollback can normally be encountered by inadvertently rolling the tape rolls backwards by normal vibratory forces or, due to the curvature of tape roll 12, rollback may be caused by the natural tendency of the curved tape end length 12*a* to roll back onto the roll 12 if not secured. By securing the tape extent 17, the engagement about opening 44 prevents such inadvertent rollback of tape length 12*a*. Advantageously, however, while preventing rollback, the tape end length 12*a* may be pulled outwardly, from the roll 12 by pulling on the end 12*b* thereof extending out of the chamber 30. The force used to pull the tape end 12*b* will normally greatly exceed the above described adhesive and frictional resistance and thus allows an additional length of tape to be pulled from the roll 12. Once a desired length of tape is pulled from roll 12, the tape end length 12*a* may be severed from the roll using blade 38 in a conventional tearing action.

As previously described and shown in FIG. 1, blade 38 is attached to the front wall 40 of dispenser 10, below opening 44. Blade 38, seated in support structure 34, has a saw-tooth cutting edge 42 which extends from the flat plate body portion 42 so that the saw-tooth cutting blade is disposed downwardly and outwardly from opening 44. The saw-tooth portion 42 is spaced from opening 44 in the instant example the spacing is approximately 0.25 inches. Thus, upon severing an end length 12*a* of tape from roll 12, the new end 12*b* of the tape which is immediately adjacently inward of blade edge 42, will remain. Since the tape roll is orientated such that the non-adhesive side of the tape will contact the blade edge 42, upon severing length 12*a* from roll 12, new tape end 12*b* will not adhere to the blade and thus rise off the blade back up toward opening 44. As tape extent 17 will be adhesively and frictionally retained in opening 44, a new tape end length 12*a* will remain, projecting substantially horizontally outward from opening 44 and thus provide a grasping end for subsequent use.

Referring again to FIGS. 3 and 4, upper shell 16 is shown attached to base shell 14. Upper shell 16 is a multi-sectioned member comprising five individual arcuate covers 52, each of which individually encloses the upper portion of chambers 30. A web of material is formed between each of the covers 52 and the base shell 14 at the junction thereof to form hinge members 54. These hinges allow each cover to be selectively opened independently of each other to access one or more of the tape receiving chambers 30.

As shown in FIG. 4, cover 52 includes a latch member 56 at the end opposite hinge 54. Latch member 56 engages the front wall 40 of base shell 16 and seats on top of upper portion 40*a* when the cover 52 is in a closed position. In this position, cover 52 is in a non-interfering position with respect to opening 44. As above described, opening 44 and slot 50 provide an accessible tape end 12*a* exteriorly of housing 10 and since the cover 52 does not interfere with this tape end, the cover may be opened or closed without engaging the tape end. Further, covers 52 include an extending end portion 53 which serves as a handle to open and close the covers (FIG. 1). In addition to opening and closing the covers, end portions 53 overhang blade 38 in the closed position to cover the saw-tooth edge 42 thereof to protect the user.

A further feature of the present invention is shown in detail in FIG. 3. Partitions 28 forming the end walls of base shell 14 include on the outside surface thereof, male and female interlocking member 60 and 62, respectively. Male member 60 is generally an elongate, T-shaped member which extends exteriorly from one end partition 28 to connect with a female member of a similarly formed wire marker dispenser. Female portion 62 is an elongate, channel-type member, having a U-shaped front wall for receiving therein a T-shaped male member. Male member 60 and female member 62 are formed to be interlocking members. The T-shaped male member 60 and slotted female member 62 are shown, by way example, and it is contemplated that any interlocking configuration may be employed. Female channel 62 includes therein a centrally located detent member 63 on the back wall thereof which projects outwardly therefrom. Detent 63 is relatively resilient so that upon inserting male portion 63 into channel 62, the detent will be flexed, allowing the male portion to pass therethrough and then snap back over the male portion, securely retaining it therein. With this feature a succession of wire marker dispensers 10 can be interlocked to provide the user with any desired number of tape rolls.

Figure 8:
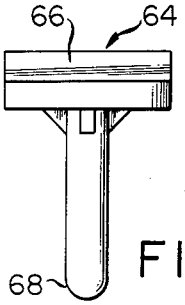
FIGS. 7 and 8 are front and side perspective showings of the mounting hook attachable to the dispenser of FIGS. 1–4.
Figure 7:
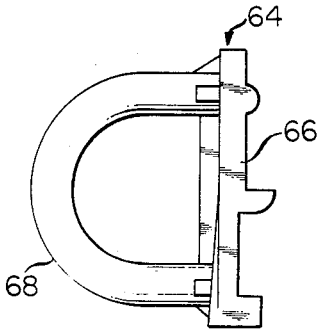

As an alternative to receiving male member 60, female channel 62 may also receive a mounting member 64 therein. Mounting member 64 as depicted in FIGS. 7 and 8, has a body portion 66 which is snap-fitted into channel 62, as described above with reference to male portion 60. Mounting member 64 further includes an outwardly extending eye hook 68. Eye hook 68 enables the user to hook one or a succession of connected dispensers to a belt loop or similar article.

Various other modifications to the foregoing disclosed embodiment will be evident to those skilled in the art. Thus, the particularly described preferred embodiment is intended to be illustrative and not limited thereto. The true scope of the invention is set forth in the following claims.

What is claimed is:

1. An apparatus for dispensing elongate tape having an adhesive surface and being wound on a roll, said apparatus comprising:

a housing for supporting said roll;

said housing including a wall having a tape dispensing opening therein for receiving a transverse extent of said tape, said wall including an elongate tape accessing slot communicating with said opening for providing insertion therethrough of said tape extent into said opening, said longitudinal extent of said opening being less that said transverse extent of said tape, and said transverse extent of said opening being substantially greater than the thickness of said tape to permit bowing of the tape upon passage through said opening.

2. The apparatus in accordance with claim 1 wherein said wall includes a wall surface defining a portion of said opening for adhesively engaging said tape extent.

3. The apparatus in accordance with claim 1 further comprising severing means supported on said housing, spaced from said opening, for severing a length of tape from said roll.

4. The apparatus in accordance with claim 3 wherein said housing further comprises an open upper end, means for rotatably supporting said roll therein such that said adhesive tape surface extending from said roll is adjacent said open upper end; and wherein said slot extends from said open upper end to said opening,

5. The apparatus in accordance with claim 4 wherein said severing means includes a blade member spaced downwardly and outwardly from said opening, thereby defining a predetermined distance for providing a free tape end upon severing a length of tape from said roll.

6. The apparatus in accordance with claim 3 wherein said housing includes a cover hingedly attached thereto for enclosing said open upper end.

7. The apparatus in accordance with claim 6 wherein said cover is disposed in closable non-interfering position with reference to said opening.

8. A dispenser for elongate adhesive tape wound on a roll comprising:

a housing for supporting said roll;

a wall on said housing, including an elongate tape dispensing opening therein for accommodating a transverse extent of said tape;

a pair of gate members on said wall adjacent said dispensing opening and having oppositely facing distal surface defining therebetween a slot communicating with said opening for providing a tape extent insertion access into said opening, said slot and said opening cooperatively defining a frictional retaining chamber having a first dimension less than the transverse extent of said tape and a second dimension substantially greater than the thickness of said tape for longitudinal, positional confinement of said transverse extent of said tape; and severing means supported on said housing for severing a length of tape for said roll.

9. The dispenser of claim 8 wherein the longitudinal expanse of said elongate opening is less than said transverse extent of said tape.

10. The dispenser of claim 9 wherein said gate members and said wall define a wall portion substantially surrounding said opening for frictionally engaging said tape extent.

11. The dispenser of claim 10 wherein said gate members define a portion of said opening and wherein said gate members include engagement portions for adhesively engaging said tape.

12. An apparatus for dispensing a plurality of adhesive tape lengths from rolls thereof, comprising:

an elongate housing;

a plurality of transverse partitions in said housing defining therebetween a plurality of individual roll receiving chambers;

means for rotatably supporting said rolls in said chambers about a central axis;

an elongate wall surface extending longitudinally on said housing;

said wall surface including adjacent each roll receiving chamber a tape dispensing opening for receiving a transverse extent of said tape; said opening having a first extent which is less than the transverse extent of said tape and a second extent greater than the thickness of said tape for frictionally engaging said tape thereon;

a pair of gate members on said wall surface adjacent each dispensing opening having engagement portions for adhesively engaging said extent and, oppositely facing distal surfaces defining therebetween a slot communicating with said opening for providing a tape extent insertion access into said opening; and an elongate severing member supported on said housing, spaced from said openings for severing lengths of said tape from said roll.

13. The dispenser of claim 12 wherein said housing includes a plurality of hingedly attached individually openable covers, each cover enclosing one tape receiving chamber, said covers being positioned in a non-interfering position with reference to said openings.

14. The dispenser of claim 12 wherein said housing includes an interconnection means for attaching an accessory article to said housing.

15. The dispenser of claim 14 wherein said interconnection means includes a channel for retentive receipt of a portion of said accessory article.

16. The dispenser of claim 15 wherein said accessory article is a similarly formed dispenser.

17. The dispenser of claim 14 wherein said accessory article comprises a mounting member for attaching said dispenser to an external structure.

* * * * *